United States Patent [19]

Inano et al.

[11] 4,129,774

[45] Dec. 12, 1978

[54] FILLING MATERIALS FOR HEATING ELEMENTS

[75] Inventors: Tozaburo Inano, Chigasaki; Katsuhiro Yamazaki, Matsudo; Minoru Otake, Kashiwa, all of Japan

[73] Assignee: Hitachi Heating Appliances Co., Ltd., Japan

[21] Appl. No.: 714,179

[22] Filed: Aug. 13, 1976

[30] Foreign Application Priority Data

Aug. 28, 1975 [JP] Japan ..... 50-104226

[51] Int. Cl.[2] ..... H05B 3/18

[52] U.S. Cl. ..... 219/552; 219/544; 252/62; 338/238; 338/244; 174/102 P

[58] Field of Search ..... 219/544, 552, 553; 338/238, 244, 250; 252/62, 63.5; 174/102 P, 118

[56] References Cited

U.S. PATENT DOCUMENTS

| | | | |
|---|---|---|---|
| 2,322,988 | 6/1943 | Wiegard | 338/238 |
| 2,701,410 | 2/1955 | Huck et al. | 338/250 X |
| 2,836,692 | 5/1958 | Griffiths | 338/250 X |
| 3,195,093 | 7/1965 | Dillon | 338/273 |
| 3,201,738 | 8/1965 | Mitoff | 338/250 X |
| 3,238,489 | 3/1966 | Hay | 338/250 |
| 3,451,861 | 6/1969 | Gordon et al. | 174/118 X |
| 3,477,058 | 11/1969 | Vedder et al. | 338/238 |
| 3,621,204 | 11/1971 | Neidhardt et al. | 338/238 X |
| 3,716,693 | 2/1973 | Bleckmann | 219/553 |
| 3,947,373 | 3/1976 | Sobajima | 252/63.5 |
| 3,970,817 | 7/1976 | Boyd | 338/238 X |

FOREIGN PATENT DOCUMENTS

| | | | |
|---|---|---|---|
| 498724 | 1/1939 | United Kingdom | 174/118 |

*Primary Examiner*—J. V. Truhe
*Assistant Examiner*—M. Puschall
*Attorney, Agent, or Firm*—Craig & Antonelli

[57] ABSTRACT

A heating element consisting of a metal pipe, an electric resistance conductor inserted into the metal pipe and a heat resistant insulating material filled between said metal pipe and said electric resistance conductor, characterized in that said heat resistant insulating material is one obtained by coating a first insulating material such as particulate fused magnesia with a second insulating material having a lower melting temperature than that of the first insulating material such as a silicone resin, which has been molten, can maintain an insulation resistance of at least $10^3$ MΩ in an atmosphere at 40° C and a relative humidity of 90%.

10 Claims, 3 Drawing Figures

FILLING MATERIALS FOR HEATING ELEMENTS

Figure 1:
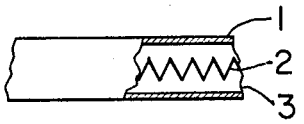

The present invention relates to a heat resistant insulating material and a heating element produced therefrom. More particularly, the invention pertains to a novel composition based on magnesia, silica or alumina which is useful as a filling material as well as a heating element produced therefrom.

As a filling material for heating elements, powdery magnesia, silica and alumina have heretofore mainly been used. In general, general heating elements to be filled with the filling material consist of an outmost protective tube of a metal, that is, a metal pipe, an electric resistance conductor made of an alloy of Fe - Cr or Ni - Cr and positioned around the central part of the metal pipe, and said filling material of magnesia, silica or alumina powder surrounding the electric resistance conductor which has been filled and compressed.

Such heating elements have a defect in that the insulation resistance of the heating elements decreases owing to the hygroscopic property of the filling material on their use in an atmosphere at a high temperature and a high humidity for a long period of time. Therefore, a remarkable improvement in the electric insulation, and particularly insulation resistance, of the filling materials used in the heating elements, when exposed to a high humidity, has heretofore been demanded.

An object of the present invention is to avoid the difficulties heretofore encountered in the heating elements.

Another object of the present invention is to provide a filling material used in heating elements which has an improved moisture resistance and an improved electric insulation.

These and other objects and advantages of the invention will appear from the following description of the invention.

According to the present invention, there is provided a heating element consisting of a metal pipe, an electric resistance conductor inserted into the metal pipe and a heat resistant insulating material filled between said metal pipe and said electric resistance conductor, characterized in that said heat resistant insulating material is one obtained by mixing with a first insulating material 1.0 to 5.0% by weight of a second insulating material having a lower melting temperature than that of the first insulating material based on the weight of the first insulating material and then heating the mixture to a temperature at which the second insulating material is molten, thereby the second insulating material being molten and coated onto the surface of the first insulating material. Alternatively, said heat resistant insulating material may be obtained by filling said mixture of the first insulating material and the second insulating material in a metal pipe and then heating the mixture to a temperature at which the second insulating material is molten, thereby the second insulating material being molten and coated onto the surface of the first insulating material. Thus, the moisture resistance of the first insulating material is improved and the electric insulation of the heating element is also improved.

Figure 2:
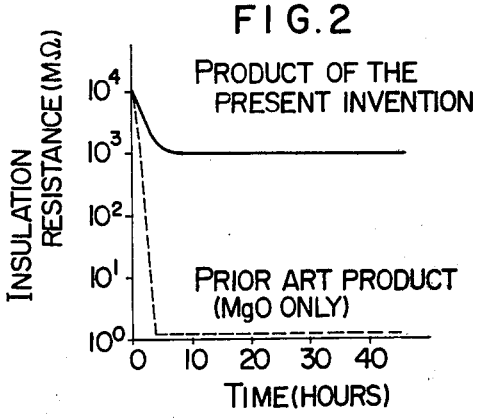

In the accompanying drawings,

FIG. 1 is a sectional view of the principal part of a general heating element, and FIG. 2 shows a comparison between the moisture resistance of the heating element according to the present invention and that of a prior art heating element.

Figure 3:
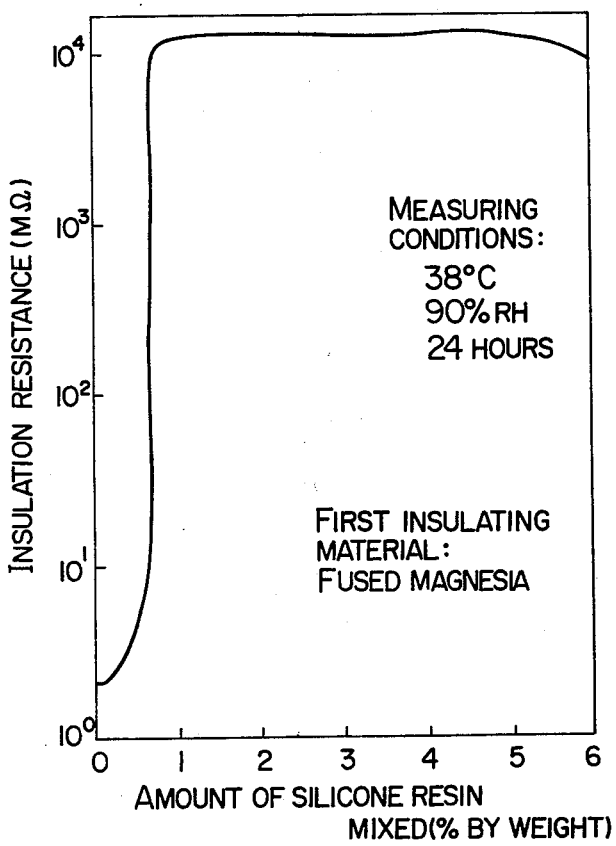

Also, FIG. 3 shows a relationship between the amount of a silicone resin mixed and insulation resistance in the present invention.

The present invention will be explained below referring to the accompanying drawings.

In FIG. 1, 1 is an outer protective tube made of a metal, that is, a metal pipe. 2 is an electric resistance conductor made of an alloy of Fe - Cr or Ni - Cr, which is positioned at the central part of said metal pipe 1. 3 is a heat resistant insulating material, which is filled and compressed around said electric resistance conductor 2. Powdery magnesia, silica and alumina may mainly be used as the heat resistant insulating material.

The present invention relates to an improvement in the insulation resistance of said heat resistant insulating material 3. From viewpoints of its production process, the product and its composition, a small amount of a second insulating material having a lower melting temperature than that of a first insulating material is mixed with the first insulating material and the mixture is heated and molten at a temperature at which the second insulating material is molten. Thus, the first insulating material is coated with the second insulating material, and the electric insulation of the heating element can be improved as compared with prior art heating elements. Here, as the first insulating material, particulate fused magnesia, silica or alumina may be used. As the second insulating material, a silicone resin powder, a heat resistant epoxy resin powder, a poltetrafluoroethylene resin powder, an unsaturated or copolymerized polyester resin powder or glass powder may be used. Also, the amount of the second insulating material mixed must be 1.0 to 5.0% by weight based on the weight of the first insulating material as is clear from a relationship between the amount of a silicone resin mixed and the insulation resistance of the heating element produced therefrom as shown in FIG. 3.

The following examples illustrate the present invention.

EXAMPLE 1

With fused magnesia powder having a particle size of 40 to 325 meshes (as the first insulating material) is mixed 2.0% by weight of a liquid silicone varnish (as the second insulating material) based on the weight of the first insulating material. The mixture is heated at about 150° C. to keep the silicone varnish at a semicured state, and is then ground. The particulate mixture thus obtained is filled into a metal pipe containing an electric resistance conductor at the center thereof. The filling ratio of the filling material is more than 75%. The second insulating material is then rebaked at 450° C. for 15 minutes. As shown in FIG. 2, the thus obtained heating element is superior in moisture resistance to a prior art heating element using only magnesia.

A similar result can be obtained by replacing said silicone varnish by a silicone sealant. Also, the rebaking temperature may be any temperature higher than the temperature, at which the second insulating material has been kept at a semi-cured state, and up to 450° C.

EXAMPLE 2

With fused magnesia powder having a particle size of 40 to 325 meshes (as the first insulating material) is mixed 2.0% by weight of a particulate silicone resin powder having a particle size of 100 to 325 meshes (as the second insulating material) based on the weight of the first insulating material. The mixture is filled into a metal pipe containing an electric resistance conductor at the center thereof. The filling ratio of this filling material is more than 75%. The filling material is then baked at 200 to 450° C. for 15 minutes to coat the first insulating material with the second insulating material.

EXAMPLE 3

With fused magnesia powder having a particle size of 40 to 325 meshes (as the first insulating material) are mixed 3.0% by weight each of a particulate heat-resistant epoxy resin powder, an unsaturated polyester resin powder and a copolymerized polyester resin powder (as the second insulating material) based on the weight of the first insulating material. The thus obtained filling materials are then filled into a metal pipe containing an electric resistance conductor at the center thereof. The filling ratio of these filling materials is more than 75%. The filling materials are then baked at 200 to 400° C. for 15 minutes to coat the magnesia powder with the second insulating material. The thus obtained heating elements may be used at a temperature up to 200° C.

EXAMPLE 4

With fused magnesia powder having a particle size of 40 to 325 meshes (as the first insulating material) is mixed 5.0% by weight of glass powder having a volume resistivity of at least $10^2$ Mω-cm at 400° C. (as the second insulating material) based on the weight of the first insulating material. The mixture is filled into a metal pipe containing an electric resistance conductor at the center thereof. The filling ratio of this filling material is more than 75%. The filling material is then baked at a temperature of 100° C. higher than the softening temperature of the glass for 15 minutes.

The embodiments of the present invention are summarized as follows:

(1) With a substrate material, that is, the first insulating material such as, for example, particulate fused magnesia, silica or alumina is mixed 1.0 to 5.0% by weight of the second insulating material having a lower melting temperature than that of the first insulating material such as, for example, a silicone resin, a copolymerized polyester resin or glass powder based on the weight of the first insulating material. The mixture is then heated to a temperature at which the second insulating material is molten to melt the second insulating material. The thus obtained heat resistant insulating material wherein the substrate material has been coated with the molten second insulating material is used as a filling material for heating elements.

(2) With a substrate material, that is, the first insulating material such as, for example, particulate fused magnesia, silica or alumina is mixed 1.0 to 5.0% by weight of the second insulating material having a lower melting temperature than that of the first insulating material such as, for example, a silicone resin powder, a copolymerized polyester resin powder or glass powder based on the weight of the first insulating material. The mixture is filled into a metal pipe containing an electric resistance conductor at the center thereof at a filling ratio of more than 75%. The mixture is then heated to a temperature at which the second insulating material is molten to melt the second insulating material which is coated onto the surface of the first insulating material.

According to the present invention, a heating element consisting of a metal pipe, an electric resistance conductor inserted into said metal pipe, and a heat resistant insulating material filled between said metal pipe and said electric resistance conductor can always maintain an insulation resistance of at least $10^3$ M Ω in an atmosphere at 40° C. and a relative humidity of 90% by using a heat resistant insulating material produced by coating the first insulating material such as, for example, particulate fused magnesia with the second insulating material having a lower melting temperature than that of the first insulating material such as, for example, a silicone resin. Thus, the insulation resistance of the heating elements according to the present invention is remarkably improved as compared with prior art heating elements having an insulation resistance of about 1 M Ω.

What is claimed is:

1. A heating element consisting of a metal pipe, an electric resistance conductor inserted into the metal pipe and a heat resistant insulating material filled between said metal pipe and said electric resistance conductor, characterized in that said heat resistant insulating material is one obtained by mixing with a first insulating material of particulate fused magnesia 1.0 to 5.0% by weight of a second insulating material selected from the group consisting of a silicone resin powder, an epoxy resin powder, polytetrafluoroethylene resin powder, and an unsaturated or copolymerized polyester resin powder, said second insulating material having a lower melting temperature than that of the first insulating material based on the weight of the first insulating material, and heating the mixture to a temperature at which the second insulating material is molten to melt the second insulating material and coat the surface of the first insulating material with the molten second insulating material.

2. A heating element according to claim 1, wherein the second insulating material is a silicone resin powder.

3. A heating element according to claim 1, wherein the second insulating material is a polytetrafluoroethylene resin powder.

4. A heating element according to claim 1, wherein the second insulating material is an epoxy resin powder.

5. A heating element according to claim 1, wherein the second insulating material is an unsaturated or copolymerized polyester resin powder.

6. A heating element consisting of a metal pipe, an electric resistance conductor inserted into the metal pipe and a heat resistant insulating material filled between said metal pipe and said electric resistance conductor, characterized in that said heat resistant insulating material is one obtained by mixing with a first insulating material of particulate fused magnesia 1.0 to 5.0% by weight of a second insulating material selected from the group consisting of a silicone resin powder, an epoxy resin powder, polytetrafluoroethylene resin powder, and an unsaturated or copolymerized polyester resin powder, said second insulating material having a lower melting temperature than that of the first insulating material based on the weight of the first insulating material, filling the mixture into a metal pipe, compressing and then heating the mixture to a temperature at which the second insulating material is molten to melt the second insulating material and coat the surface of the first insulating material with the molten second insulating material.

7. A heating element according to claim 6, wherein the second insulating material is a silicone resin powder.

8. A heating element according to claim 6, wherein the second insulating material is a polytetrafluoroethylene resin powder.

9. A heating element according to claim 6, wherein the second insulating material is an epoxy resin powder.

10. A heating element according to claim 6, wherein the second insulating material is an unsaturated or copolymerized polyester resin powder.

* * * * *